US005419511A

United States Patent [19]

Takahashi et al.

[11] Patent Number: 5,419,511

[45] Date of Patent: May 30, 1995

[54] AUTOMATIC WINDING MACHINE FOR TAPE-LIKE ARTICLES

[75] Inventors: Kihei Takahashi; Toshikazu Ueda, both of Toyama, Japan

[73] Assignee: Yoshida Kogyo K.K., Tokyo, Japan

[21] Appl. No.: 111,877

[22] Filed: Aug. 26, 1993

[30] Foreign Application Priority Data

Aug. 26, 1992 [JP] Japan ..... 4-227418

[51] Int. Cl.[6] ..... B65H 19/28; B65H 19/29

[52] U.S. Cl. ..... 242/530.1; 242/532.3; 242/532.7; 242/533.1

[58] Field of Search ..... 242/530.1, 527, 532.3, 242/532.7, 533.1

[56] References Cited

U.S. PATENT DOCUMENTS

| | | | |
|---|---|---|---|
| 3,782,664 | 1/1974 | Alberto | 242/532.7 X |
| 4,094,474 | 6/1978 | Stollenwerk et al. | 242/532.7 X |
| 4,160,529 | 7/1979 | Hutzenlaub et al. | 242/532.3 X |
| 4,508,279 | 4/1985 | Tokuno et al. | 242/532.7 X |
| 4,941,620 | 7/1990 | Wilsch et al. . | |
| 5,022,597 | 6/1991 | Morizzo . | |
| 5,040,737 | 8/1991 | Zeroni et al. . | |
| 5,222,679 | 6/1993 | Dropczynski et al. . | |

FOREIGN PATENT DOCUMENTS

| | | | |
|---|---|---|---|
| 0036311 | 9/1981 | European Pat. Off. . | |
| 0202591 | 11/1986 | European Pat. Off. . | |
| 0221737 | 5/1987 | European Pat. Off. . | |
| 0387632 | 9/1990 | European Pat. Off. . | |
| 0442038 | 8/1991 | European Pat. Off. . | |
| 2138088 | 5/1973 | Germany . | |
| 2825154 | 12/1979 | Germany . | |
| 3806200 | 9/1989 | Germany . | |
| 58-157666 | 9/1983 | Japan | 242/532.3 |
| WO91/04935 | 4/1991 | WIPO . | |
| WO92/05100 | 4/1992 | WIPO . | |

*Primary Examiner*—John M. Jillions
*Attorney, Agent, or Firm*—Hill, Steadman & Simpson

[57] ABSTRACT

An automatic winding machine for automatically and certainly guiding and sticking not only one flexible tape-like article, but also a plurality of flexible tape-like articles on desired spool peripheral surface. While adhesive portions of one or more double-sided adhesive tapes fed in parallel are cut to every predetermined length, a separated paper is wound for a predetermined length. The severed adhesive portions of the predetermined length are stuck onto the back surfaces of the leading ends of the one or more tape-like articles. Individual leading ends of the tape-like articles on which the adhesive tapes are respectively stuck, are gripped by grippers and moved through the guide member to the winding spool. Thereafter, the leading ends of the tape-like articles are pressed and stuck onto the peripheral surface of the winding spool to wind automatically the tape-like articles for every predetermined length on the winding spools.

4 Claims, 10 Drawing Sheets

AUTOMATIC WINDING MACHINE FOR TAPE-LIKE ARTICLES

BACKGROUND OF THE INVENTION

1. Field of the Invention

This invention relates generally to a machine for automatically winding flexible tape-like articles, such as surface fasteners, slide fastener chains and ornamental tapes, and more particularly to an automatic winding machine for flexible tape-like articles, which is provided with a mechanism for efficiently securing a leading end of the tape-like article on a spool body.

2. Prior Art

The conventional automatic winding machine is disclosed for example in Japanese Patent Publication of Unexamined Application No. S61-263574. According to the winding apparatus, a spool includes a hollow cylinder body having an opening defined in the annular periphery wall of the spool body. The axial hole in the spool body is circumstanced to be under negative pressure to create a suction force acting around the cylinder body. The leading end of the tape-like article is sucked toward the opening and adhered to the annular wall of the spool body to wind the tape-like article on the spool body. The mechanical holding means includes a row of locking needles movably mounted in the hollow portion so as to selectively project outwardly beyond the annular wall through the opening of the spool body to be threaded through the leading end of the tape-like article at the start of winding the tape-like article around the spool body.

According to the winding apparatus, the trough-like guide member is provided adjacent to and above the spool body in perpendicular relation to the axis of the spool body to introduce the leading end of the flexible tape-like article onto the spool body. The leading end of the flexible tape-like article guided by the guide member and fed continuously is hung from the tip end of the guide member toward the peripheral surface of the spool body and then is locked on the spool body by the suction force to wind automatically the flexible tape-like article on the spool thereafter.

With the tape-like article winding apparatus disclosed in the above Japanese Patent Publication, since the leading end of the tape-like article is held on the spool body without the time-consuming manual operation, the tape-like article may be efficiently wound on the spool having large flanges attached to both sides of the spool body to achieve the complete automation in the start of winding.

Thereupon, since the spools for winding the tape-like articles are expendables, the cost of the spools should be reduced as much as possible. However, since the spool comprises a hollow cylindrical body having an elongate opening defined in its peripheral wall to assure the suction force of the hollow body or the projection and retraction of locking needles, the spool which is generally used and is inexpensive cannot be used due to the necessity of unique structure described above, so that the cost increases.

According to the feed mechanism for feeding the flexible tape-like article to the winding spool in the automatic winding apparatus, since the mechanism intends to guide the tape-like article through the trough-like guide members onto the peripheral surface of the winding spool, it is not assured to hold surely the leading end of the tape-like article on the peripheral surface of the spool. When the leading end of the tape-like article is hung down for long distance and the winding operation is neverthless started, the tape-like articles produce ill-wound appearance and different wound lengths to reduce the commercial value when a plurality of tape-like articles are simultaneously wound. Therefore, the inspections for wound appearance .and wound lengths require the time and the labor to deteriorate its economy and productivity.

SUMMARY OF THE INVENTION

It is therefore an object of this invention to solve the above-mentioned disadvantages of the automatic winding apparatus of the tape-like article and to provide a tape-like article winding machine which permits individual leading ends of continuously fed plural tape-like articles to be automatically and surely stuck on respective peripheral surfaces of desired spools, even when one or plural tape-like articles are wound as desired.

In order to achieve the object of this invention, there is provided a machine for automatically winding a flexible tape-like article comprising a double-sided adhesive tape sticking unit having a feed section for a double-sided adhesive tape, a severing section for severing the adhesive portion of the adhesive tape fed from the feed section into a predetermined length, and a rewinding section for intermittently rewinding a separated paper for a predetermined length, said adhesive tape sticking unit is for sticking the severed adhesive portion to a back surface of a leading end of the tape-like article fed from the feed section, a tape-like article winding unit having an automatic exchanging mechanism for winding spools, and a guide means for the tape-like article, said winding unit is for winding the tape-like article for a predetermined length on the winding spool, and a tape-like article drawing and winding unit having a tape end gripping means for gripping the leading end of the tape-like article on the back surface of which the double-sided adhesive tape is adhered by the sticking unit and a pressing and securing means for pressing and securing the leading end on the peripheral surface of the winding spool, the tape-like article drawing and winding unit being displaceable between the adhesive tape sticking unit and the winding spool of the tape-like article winding unit.

Moreover, the tape-like article feed section of the feed unit is composed of a feeding and severing portion for feeding and severing first and second tape-like articles for a predetermined length and a joining portion for joining the severed piece of the .second tape-like article to a feeding end of the first tape-like article.

According to the favourable modification, guide members for guiding plural tape-like articles in parallel are disposed between the double-sided adhesive tape sticking unit and the winding spool of the tape-like article winding unit, and the tape-like article winding unit has an automatic empty spool supplying means.

The operation of the automatic winding machine of this invention will be illustrated with reference to the favourable form;

When a first tape-like article is wound for a predetermined length on a spool, the feeding of the first tape-like article is stopped, and at the same time, a feed gripper is actuated to project a second tape-like article for a predetermined length into a passage of a movable cutter. Herein, the movable cutter is moved upwardly to cut off the first tape-like article and then to cut off the projected end of the second tape-like article in co-operation with the stationary cutter. Then, since the severed end of first tape-like article is put on a downwardly inclined lower surface of the passage and bent upwardly, the rear end of the severed second tape-like article is projected rearwardly from the severed end of the first tape-like article and the forwarded tip end of the severed second tape-like article is attached to the severed end of the first tape-like article.

Thus, when the first tape-like article is wound after the severed piece of the second tape-like article is attached to the severed end of the first tape-like article, the projected end of the severed piece is joined onto the wound surface layer by a proper press means to be a finished product. When the finished product is removed from the winding unit, the product is always kept from collapsing.

Nextly, when a new winding spool for the succeeding winding is set in a winding unit, a leading end of a new first tape-like article is fed from the tape-like article feed unit through a discharge guide for a predetermined length. Before the leading end of the first tape-like article is fed from the discharge guide of the feed unit, a double-sided adhesive tape feed section is located far below a press roller. When the leading end of the first tape-like article reaches to the location of being projected slightly from the press roller after it is contacted with the lower surface of the press roller, the double-sided adhesive tape feeding portion is lifted up to hold the leading end of the first tape-like article between the press roller and the double-sided adhesive tape sticking roller. And at the same time, the adhesive tape severing means is actuated to exert a cutting blade upon the surface of the adhesive tape guiding portion to cut off the adhesive tape while leaving the separated paper uncut.

When the double-sided adhesive tape is cut off, the cutting blade returns, and at the same time, the sticking roller is rotated at the predetermined angle to feed the first tape-like article outwardly and to adhere the severed piece of the double-sided adhesive tape onto the back surface of the first tape-like article so as to draw the tape-like article from the discharge guide for the predetermined length. Then, the separated paper rewinding roller is simultaneously driven to wind the separated paper on the rewinding roller. At this time, the gripper of the tape-like article drawing and winding unit is standing-by in front of the press roller and the sticking roller to grip the leading end of the first tape-like article.

When the severed piece of the double-sided adhesive tape is adhered to the back surface of the leading end of the first tape-like article, the rotation of the separated paper rewinding roller is stopped and the leading end of the tape-like article is fed into the gripper while being held between the press roller and the sticking roller. When the leading end of the tape-like article is gripped by the gripper, the double-sided adhesive tape feeding portion is lowered to release the holding. The leading end of the tape-like article is transferred by means of the gripper to the predetermined location of the tape-like article winding unit.

The tape-like article drawing and winding unit provided with the gripper stands-by in the upwardly front location of the tape-like article winding unit in winding of the first tape-like article. When the double-sided adhesive tape is adhered to the leading end of the first tape-like article, the drawing and winding unit is moved horizontally to the tape-like article gripping location in front of the press roller and the sticking roller. After the leading end of the tape-like article is gripped by the gripper, the drawing and winding unit is returned to the original location and is moreover displaced downwardly therefrom. Then, one of tape-like article pressing portions is inclined downwardly and the press member pushes the leading end surface of the first tape-like article on the peripheral surface of the spool body to stick and join the double-sided adhesive tape adhered to the back surface of the leading end onto the peripheral surface of the spool body.

When this sticking and joining operation is finished, the tape-like article drawing and winding unit is returned to the stand-by location and the actuation of the winding unit is started to commence the winding of the first tape-like article. When the first tape-like article is wound for a predetermined length, the movable cutter of the tape-like article feed unit is lifted up to .cut off the first tape-like article and then to cut off the projected end of the second tape-like article in co-operation with the stationary cutter. When the severed piece of the second tape-like article is adhered to the severed end of the first tape-like article, the end of the first tape-like article is attached and secured to the surface of the wound surface layer via the projected end of the severed piece to finish the winding. The above-mentioned operation is repeated to wind automatically the tape-like article on the winding spool for the predetermined length and to join the end to the wound surface.

Many other advantages and features of this invention will become manifest to those versed in the art upon making reference to the detailed description and the accompanying drawings in which preferred structural embodiments incorporating the principles of this invention are shown by illustrative example.

DETAILED DESCRIPTION

Preferred embodiments of this invention will be illustrated in detail with reference to the accompanying drawings.

Figure 1:
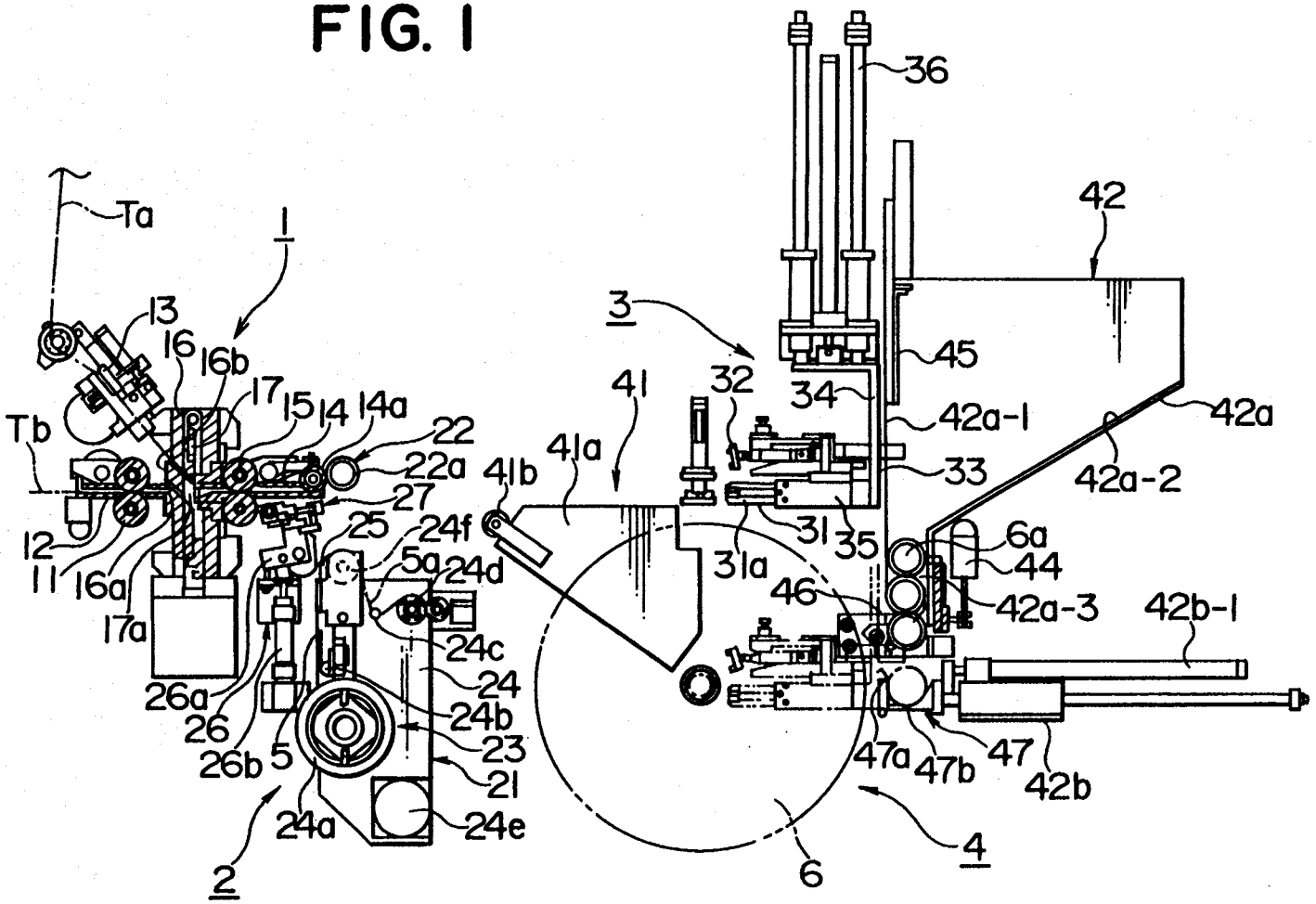
FIG. 1 is a side view showing a whole structure of an automatic winding machine for surface fasteners according to this invention.
Figure 2:
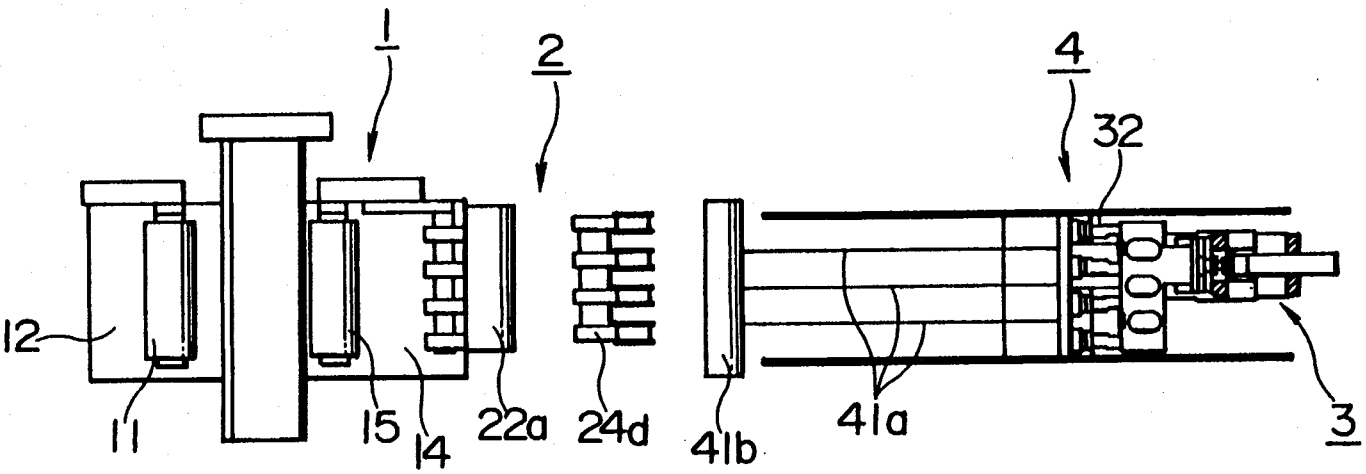
FIG. 2 is a plan view showing a whole structure of the main part of the automatic winding machine.

An automatic winding apparatus of this invention comprises a flexible tape-like article feed unit 1, a double-sided adhesive tape sticking unit 2, a flexible tape-like article drawing and winding unit 3, and a flexible tape-like article winding unit 4, as shown in FIG. 1.

A known feed unit disclosed for example in Japanese Patent Publication No. H 1-15283 is adapted in the tape-like article feed unit 1 of this automatic winding machine. That is, the tape-like article feed unit 1 is provided with a severing and joining means for severing a joint piece from a second tape-like article Ta of a surface fastener to a predetermined length and attaching such a joint piece to a desired length on a first tape-like article Tb of a mating surface fastener.

In this feed unit 1, a pair of upper and lower feed rollers 11 and a feed guide 12 are horizontally arranged and a feed gripper 13 for the second tape-like article Ta is disposed above the feed rollers and the feed guide. A pair of upper and lower auxiliary rollers 15 and a discharge guide 14 are also arranged at the desired interval from the feed guide 12 in the discharge side of the first tape-like article Tb. The discharge guide 14 is extended for the predetermined length in front of the auxiliary rollers 15 and a first tape-like article discharging roller **14*a* is provided on the tip end of the discharge guide 14. The feed rollers 11 and the discharge roller 14*a*** are associated with a stepping motor not shown in the drawing to carry out the stopping and feeding the first tape-like article Tb for every predetermined length.

A stationary cutter 16 and a movable cutter 17 are disposed between the feed guide 12 and the discharge guide 14. The stationary cutter 16 has a first guide path **16*a* for horizontally feeding the first tape-like article Tb and an inclined second guide path 16*b* for feeding the second tape-like article Ta in a downwardly inclined direction. The movable cutter 17 is vertically moved and slid along the front surface of the stationary cutter 16 by a proper drive means. A downwardly inclined passage 17*a* is formed in the central portion of the movable cutter 17 to pass the first and second tape-like articles Tb and Ta. The feed side edge of a lower wall surface of the passage 17*a*** is formed as a cutter blade and the upper wall surface thereof is formed as a guide surface for the second tape-like article Ta which is supplied in the downwardly inclined direction.

With this structure, when the first tape-like article Tb of the desired length is wound onto the winding spool, the feeding is stopped, and at the same time, the feed gripper 13 is actuated to project the second tape-like article Ta for the predetermined length through the second guide path **16*b* into the passage 17*a* of the movable cutter 17. Nextly, the movable cutter 17 is lifted up to cut off the first tape-like article Tb and then to cut off the projected portion of the second tape-like article Ta into a joint piece in co-operation with the stationary cutter 16. Then, since the severed trailing end of the first tape-like article Tb is put on the downwardly inclined lower surface of the passage 17*a*** and bent upwardly, the leading end of the joint piece is attached to the severed trailing end of the first tape-like article Tb while the trailing end of the joint piece of the second tape-like article Ta is projected rearwardly from the severed end of the first tape-like article.

Thus, when the first tape-like article Tb is wound up after the joint piece of the second tape-like article Ta is attached to the severed trailing end of the first tape-like article Tb, the projected end of the joint piece is attached and secured onto the surface of the wound surface layer to provide a finished product which can be prevented from being loosened off the reel after it has been removed from the winding unit 4.

The tape-like article feed unit 1 is shown as the illustrative example and is not limited to the one described above, but various types of feed units having the same function may be also adapted, and various modification of the feed unit of this invention may be used as disclosed in the above-mentioned Publication. Similarly, the first and second tape-like articles are described as the surface fasteners, but the first tape-like article Tb may be a slide fastener, a narrow film, an ornamental tape or the like and the second tape-like article Ta may be a pressure-sensitive adhesive tape or the like.

A sticking unit 2 for sticking a double-sided adhesive tape of a predetermined length is located on the tape-like article discharge side of the feed unit 1. This double-sided adhesive tape sticking unit 2 is composed of a double-sided adhesive tape feeding and sticking means 21 for sticking the double-sided adhesive tape 5 of the predetermined length to the back surface of the leading end portion of the first tape-like article Tb from the discharge guide 14 of the feed unit 1, and an adhesive tape severing means for severing only the adhesive portion of the adhesive tape 5 to the predetermined length.

The double-sided adhesive tape feeding and sticking means 21 includes an upper stationary press roller section 22 and a vertically movable double-sided adhesive tape feeding section 23 which is disposed below the stationary press roller section 22, as shown in FIG. 1. The stationary press roller section 22 has a press roller **22*a* which is disposed to contact with the upper surface of the tape-like article fed from the discharge guide 14 of the feed unit 1**.

The double-sided adhesive tape feeding section 23 is composed of a block 24 which is vertically movable toward the press roller **22*a* by a cylinder not shown in the drawing. As shown in FIG. 1 and in FIG. 2 to 6 which are illustrative views of the operation of the sticking unit 2, the block 24 has a reel 24*a* with the double-sided adhesive tape 5 wound around it, a plurality of rollers 24*b*–24*e* for guiding the double-sided adhesive tape 5 and rewinding only the separated paper 5*a*, and a double-sided adhesive tape sticking roller 24*f* which is disposed opposite to the press roller 22*a*. The unwinding reel 24*a* for the double-sided adhesive tape 5 is rotatably supported in the lower central portion of the block 24. The adhesive tape 5 wound on the reel 24*a* is passed through the tension roller 24*b* to the peripheral surface of the adhesive tape sticking roller 24*f*. Only the separated paper 5*a* is turned downwardly and guided to the guide roller 24*c* and is further passed through a pair of right and left drawing rollers 24*d* and taken up on the rewinding roller 24*e* supported in the lower end of the block 24. A guide block 25 for slidably guiding the double-sided adhesive tape 5 having the separated paper is disposed in the upper part of the running path of the double-sided adhesive tape 5 between the tension roller 24*b* and the double-sided adhesive tape sticking roller 24*f***.

The adhesive tape severing means 26 is fixed below the discharge guide 14 of the feed unit 1. As shown in FIG. 1, a severing portion 27 is disposed in the upper end of a L-shaped lever 26a which is turnably supported pivotally at the central portion thereof. A cutting blade 27a is protruded from the severing portion 27 toward the adhesive tape feeding and sticking means 21. The other end of the L-shaped lever 26a is supported by the tip end of the piston rod of the cylinder 26b. Accordingly, when the cylinder 27 is actuated, the L-shaped lever 26a is turned about the central postion thereof and the cutting blade 27a of the severing portion 27 is advanced and returned in the right and left directions of the drawing. When the double-sided adhesive tape feeding section 23 is lifted up and the severing portion 27 is turned in the right direction, the blade edge of the cutting blade 27a is positioned to contact with the surface of the guide block 25.

Figure 3:
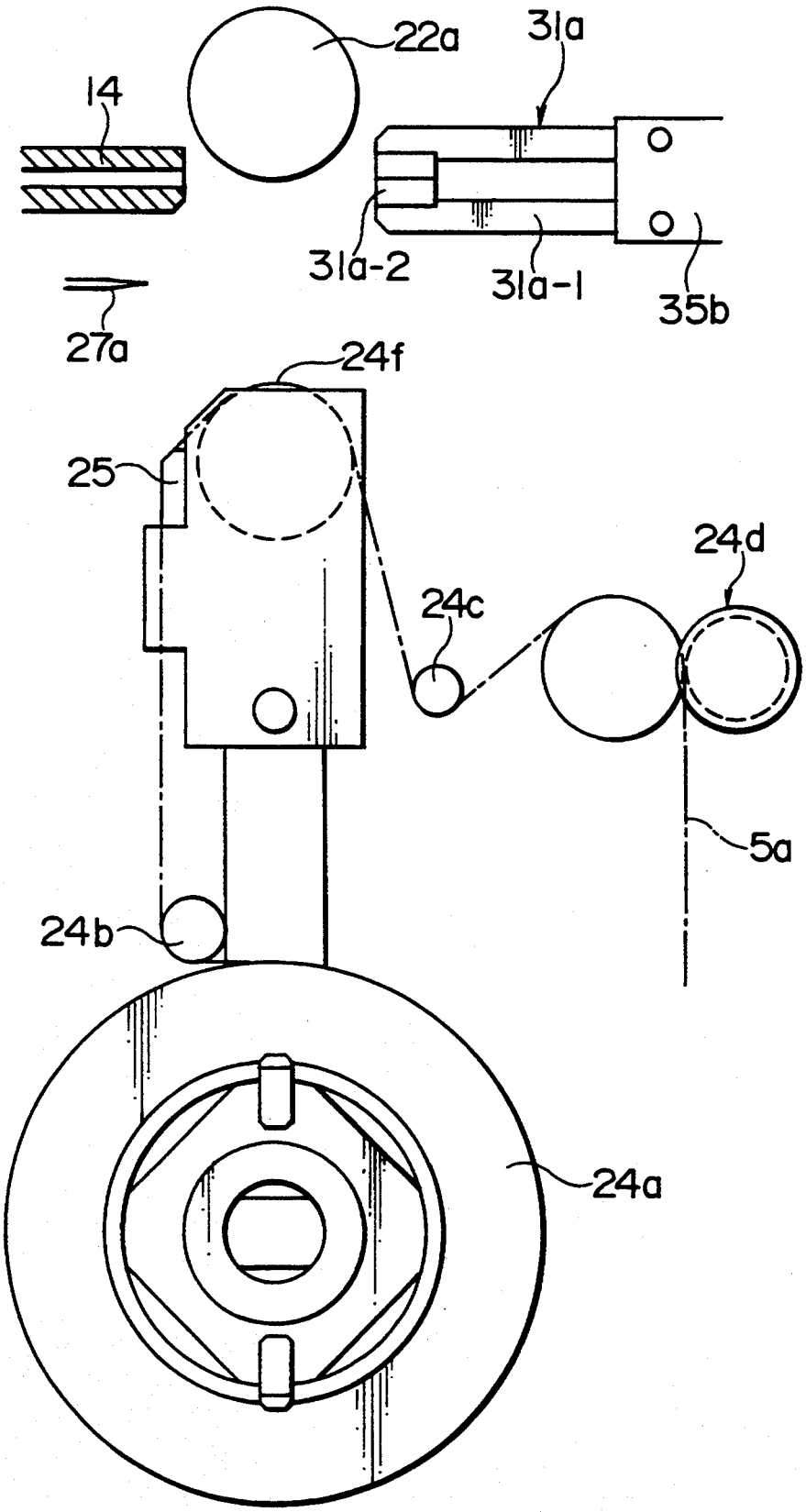
FIG. 3 is a fragmentary side view showing a situation before actuation of a double-sided adhesive tape sticking unit which is the main feature of this invention.
Figure 4:
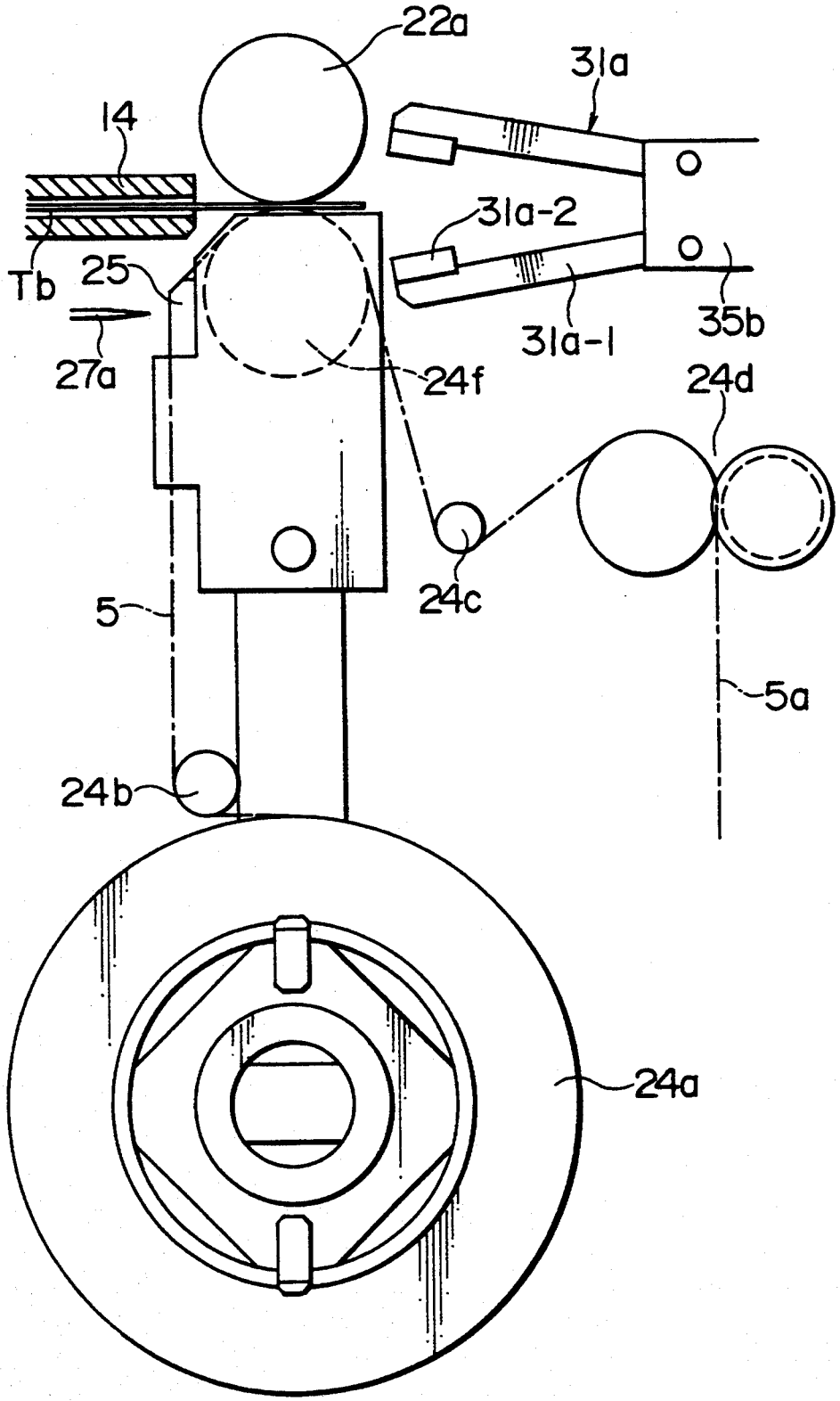
FIG. 4 is a fragmentary side view showing other situation during sticking of the adhesive tape by the sticking unit.
Figure 5:
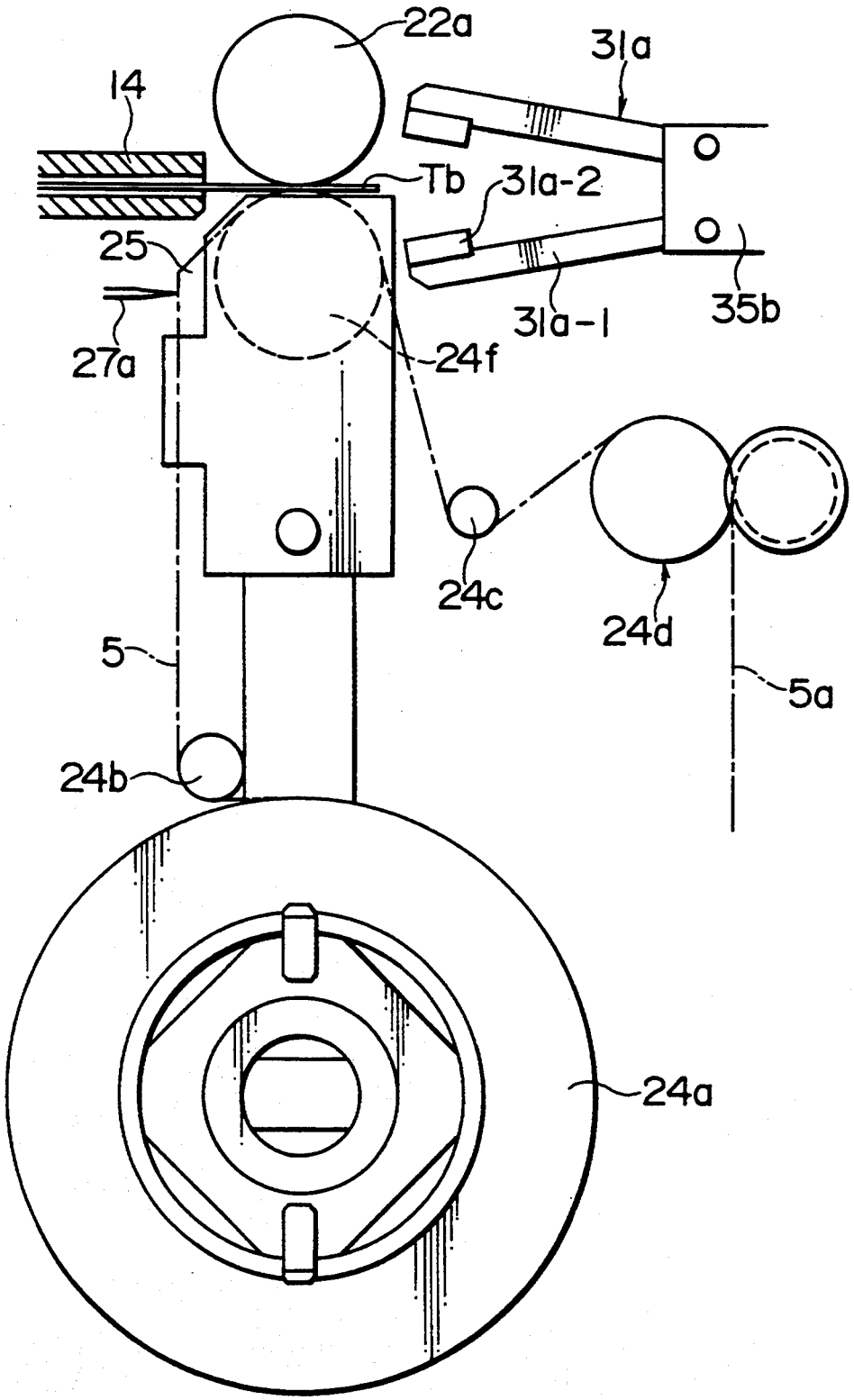
FIG. 5 is a fragmentary side view showing another situation during severing of the adhesive tape by the sticking unit.

According to the double-sided adhesive tape sticking unit 2 described above, the adhesive tape feeding section 23 is positioned below the press roller 22a as shown in FIG. 3 before the leading end of the first tape-like article Tb is fed from the discharge guide 14 of the feed unit 1. When the leading end of the first tape-like article Tb is fed from the discharge guide 14 of the feed unit 1 to contact with the lower surface of the press roller 22a and reached to a location projected slightly from the press roller 22a, the double-sided adhesive tape feeding section 23 is lifted up as shown in FIG. 4 to hold the leading end of the first tape-like article Tb between the press roller 22a and the double-sided adhesive tape sticking roller 24f. And simultaneously, the adhesive tape severing means 26 is actuated to apply the blade edge 27a to the double-sided adhesive tape 5 having the separated paper 5a so as to sever the adhesive tape 5 while leaving the separated paper 5a uncut, as shown in FIG. 5.

Figure 6:
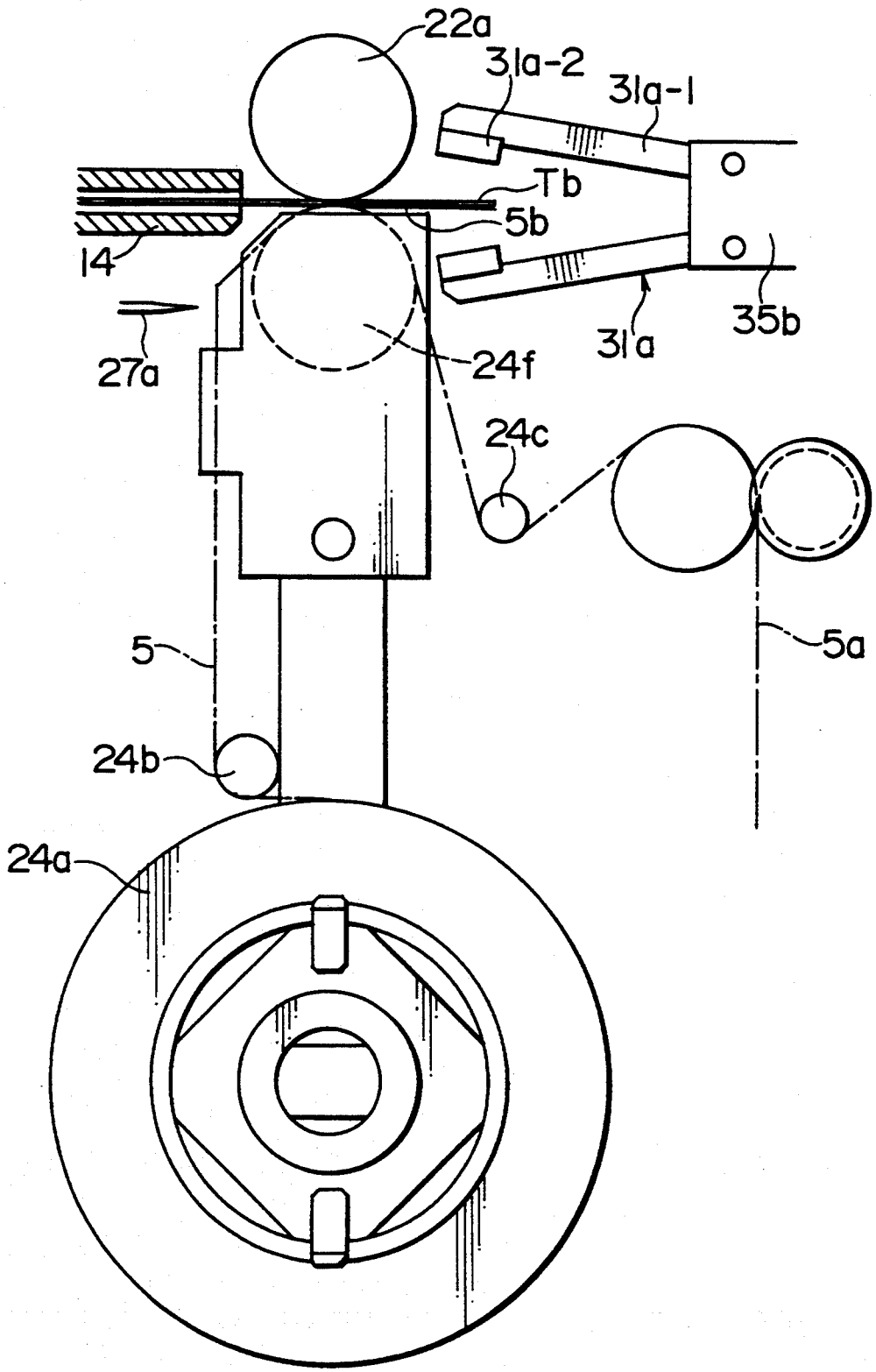
FIG. 6 is a fragmentary side view showing a further situation during sticking of the adhesive tape by the sticking unit.

When the severing operation of the double-sided adhesive tape 5 is finished up, the cutting blade 27a is returned and the double-sided adhesive tape sticking roller 24f is rotated by the predetermined rotation angle to feed out the first tape-like article Tb and the severed portion 5b of the double-sided adhesive tape 5 is stuck to the back surface of the first tape-like article Tb as shown in FIG. 6. At the same time, the rewinding roller 24e is driven to start the rotation of the drawing roller 24d and to rewind the separated paper 5a on the rewinding roller 24e.

During rewinding the separated paper 5a on the rewinding roller 24e, the severed portion 5b of the double-sided adhesive tape 5 is drawn-out together with the first tape-like article Tb and stuck onto the back surface of the first tape-like article Tb. Then, a gripper 31a of the tape-like article drawing and winding unit 3 is standing-by in front of the both rollers 22a, 24f to hold the leading end of the first tape-like article Tb.

Figure 7:
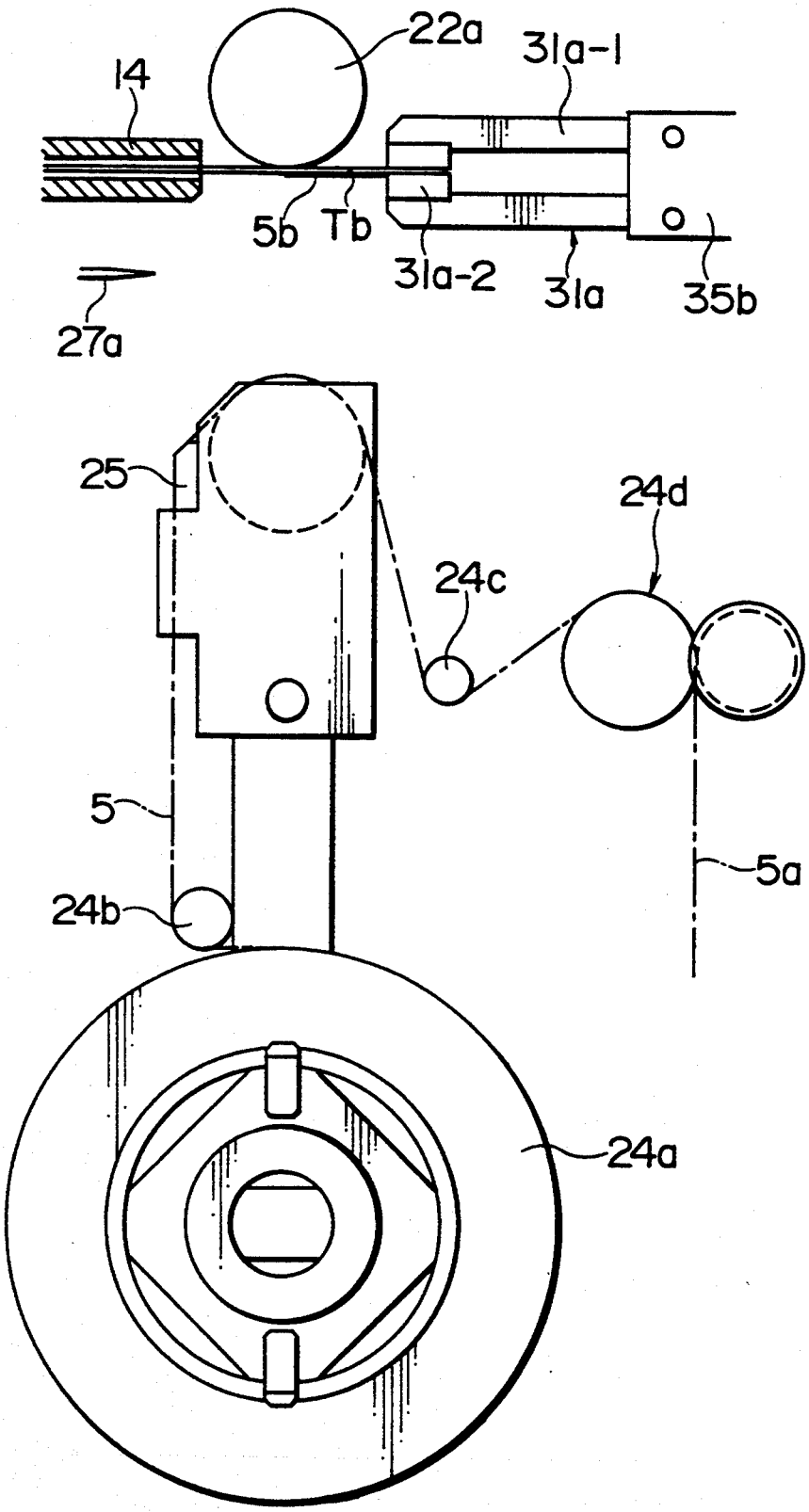
FIG. 7 is a fragmentary side view showing a gripper for gripping a leading end of a tape-like article after sticking of the adhesive tape.

When the whole severed piece 5b of the double-sided adhesive tape 5 is stuck to the back surface of the first tape-like article Tb, the rotation of the separated paper rewinding roller 24e is stopped. At that time, the leading end of the first tape-like article Tb is held between the press roller 22a and the double-sided adhesive tape sticking roller 24f and is extended into the inner portion of the gripper 31a standing-by in front of the both rollers 22a, 24f. Then, the leading end of the first tape-like article Tb is held by the gripper 31a, as shown in FIG. 6. After being held by the gripper, when the double-sided adhesive tape feeding section 23 is lowered and the gripper 31a is actuated in the predetermined operation described later while holding the tape-like article Tb as shown in FIG. 7, the leading end of the first tape-like article Tb is transferred to the desired position of the tape-like article winding unit 4.

The tape-like article drawing and winding unit 3 having the gripper 31 is standing-by in the upwardly front location of the tape-like article winding unit 4 as shown in FIG. 1 during winding of the first tape-like article Tb. When the double-sided adhesive tape 5 is stuck to the first tape-like article Tb, the tape-like article drawing and winding unit 3 is horizontally moved to a position for gripping the tape-like article between the press roller 22a and the double-sided adhesive tape sticking roller 24f. After the leading end of the first tape-like article Tb is held by the gripper 31a, it is returned to its original location and is downwardly moved therefrom.

Figure 8:
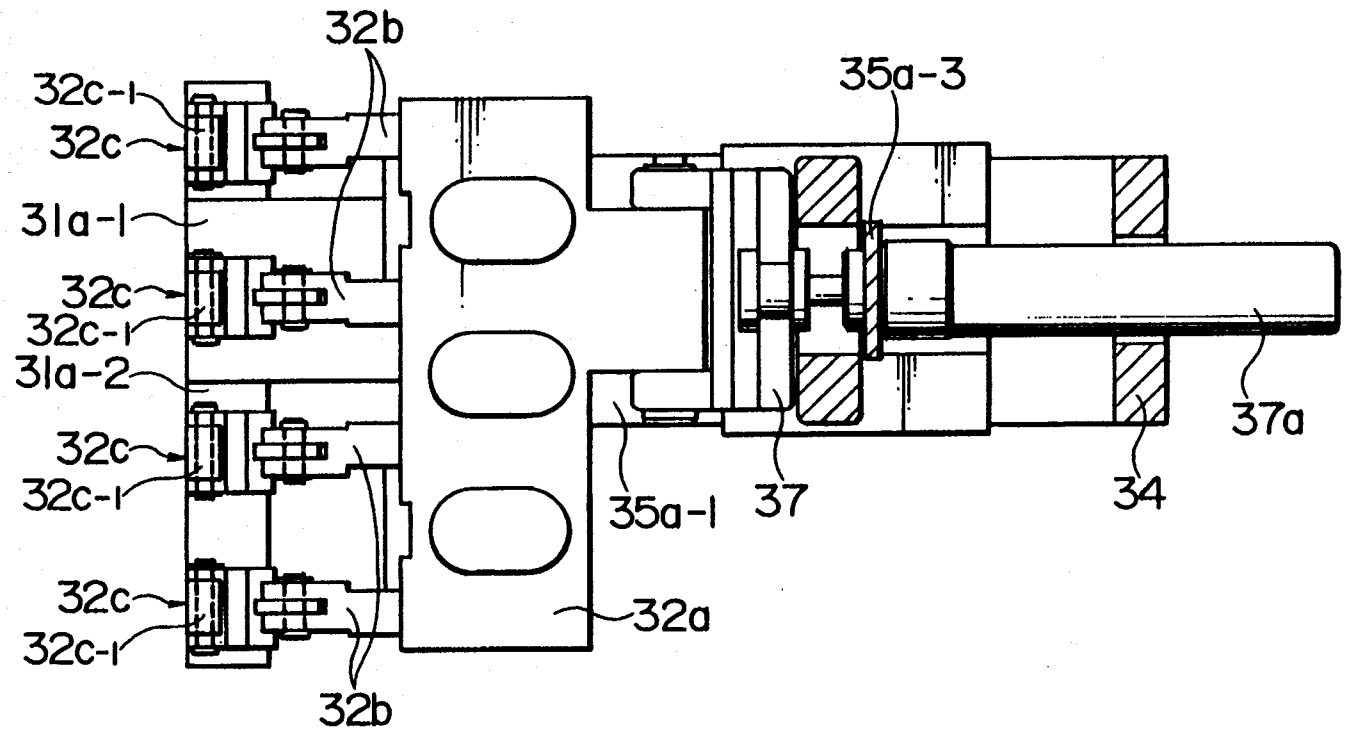
FIG. 8 is an enlarged plan view showing the main structure of a tape-like article drawing and winding unit according to this invention.
Figure 9:
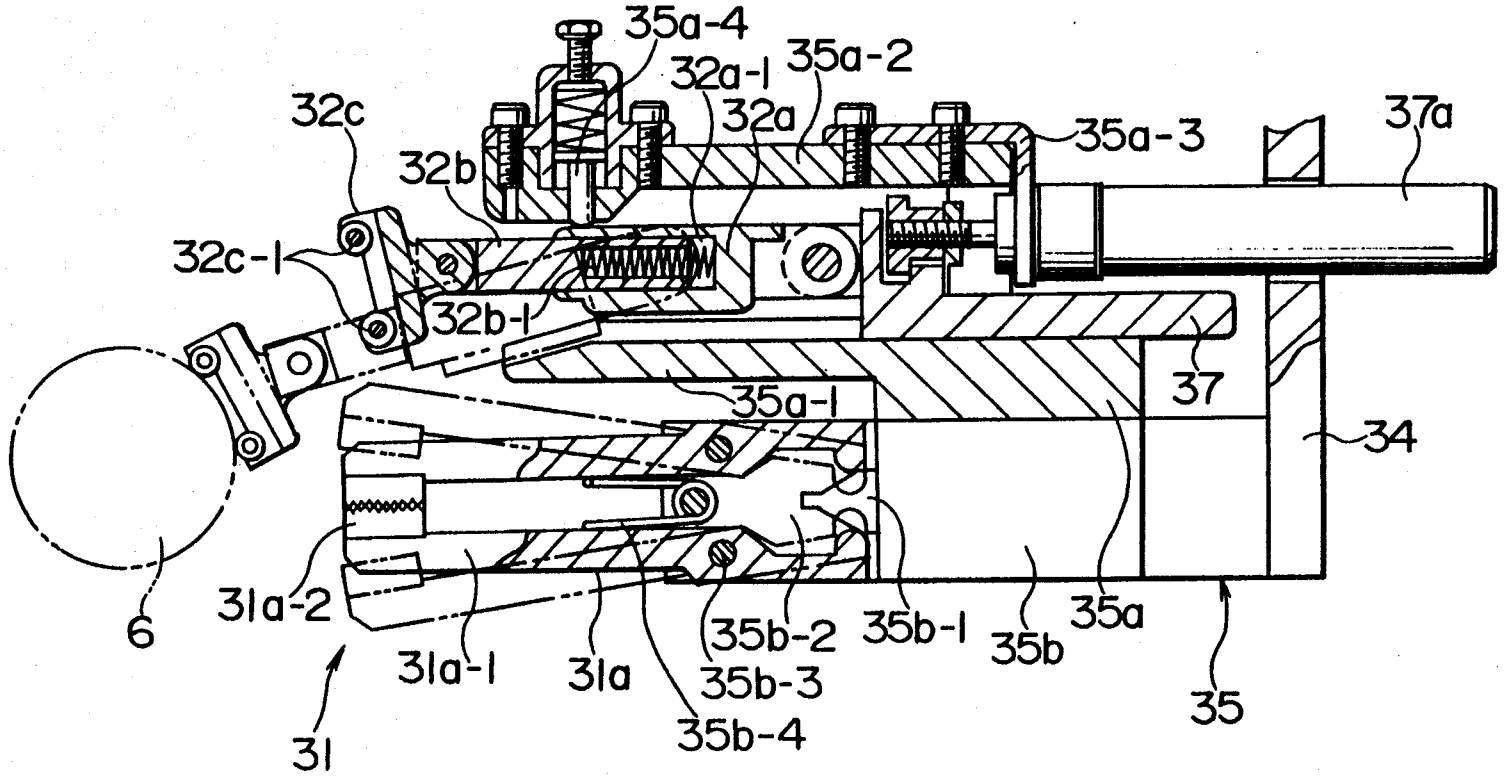
FIG. 9 is an enlarged vertical view in cross section showing the main structure of a tape-like article drawing and winding unit.

The tape-like article drawing and winding unit 3 is provided with the tape-like article holding portion 31 and the tape-like article pressing portion 32 and can be horizontally and vertically moved by the cylinder means. In FIG. 8 and FIG. 9, the tape-like article holding portion 31 and the tape-like article pressing portion 32 are shown in detail and are supported by a common support member 33. The support member 33 comprises an inversely L-shaped frame 34 and a bracket 35 projected horizontally from the lower end of the frame as shown in FIG. 1. The upper end horizontal portion of the inversely L-shaped frame 34 is attached to a vertical cylinder 36 secured to a machine base not shown, and the tape-like article holding portion 31 and the tape-like article press portion 32 are moved vertically by the vertical cylinder 36. A horizontal cylinder is also attached to the inversely L-shaped frame 34, and the tape-like article holding portion 31 and the tape-like article pressing portion 32 are also moved horizontally via the inversely L-shaped frame 34 by the horizontal cylinder.

The bracket 35 is composed of upper and lower two separate steps structure as shown in FIG. 9. The tip end of the upper surface of the bracket 35 is formed as a downwardly inclined surface and a slide groove 35a-1 is extended in the protruding direction along the whole length of the bracket 35. A guide plate member 35a-2 is parallelly disposed with a predetermined interval to the bracket 35a. A cylinder support plate 35a-3 is attached to the right end of the guide plate member 35a-2 by bolts, and a push pin 35a-4 is resiliently protruded toward the slide groove 35a-1 and is mounted in the end of the guide plate member 35a-2.

A sliding member 37 is engaged in the slide groove 35a-1 and the right portion of the sliding member 37 is engaged with the tip end of the piston red of a cylinder 37a supported by the cylinder support plate 35a-3, so that the sliding member 37 is reciprocated by the actuation of the cylinder 37a. The tape-like article pressing portion 32 is vertically rotatably connected through a pin to the left end of the sliding member 37.

The tape-like article press portion 32 comprises a base member 32a, arm members 32b, and press members 32c as shown in FIG. 8 and FIG. 9. According to this embodiment, since four first tape-like articles Tb are simultaneously wound, four sets of arm members 32b and press members 32c are also slidably accommodated in cavities 32a-1 which are parallelly formed in the base member 32a. The individual arm member 32b is accommodated via a compression spring 32b-1 in the individual cavity 32a-1 . A pair of rollers 32c-1 is provided in the end surface of the press member 32c to be contacted and pressed on the periphery of the winding spool 6. The base of the press member 32c is vertically turnably connected via a pin to the end of the arm member 32b.

When the cylinder 37a is elongated and the sliding member 37 is extruded along the slide groove 35a-1 of the bracket 35a in the left direction of FIG. 9, the tape-like article pressing portion 32 is downwardly pressed by the push pin 35a-4, so that the whole pressing portion is, downwardly inclined along the downwardly slanted surface of the bracket 35a as shown in the phantom line. The rollers 32c-1 of the press member 32c are pressed against the peripheral surface of the winding spool 6 as shown by the phantom line.

A lower bracket 35b has a wedge portion 35b-1 therein which is advanced and returned, and a pair of legs 35b-2 which are extended in parallel (in the vertical direction in FIG. 9) from the end thereof. The tape-like article holding portion 31 which is a part of the characterizing part of this invention, is held between a pair of the legs 35b-2. That is, a gripper 31a comprising a pair of upper and lower board holders 31a-1 is turnably supported between the legs 35b-2 by the pins 35a-3. When the wedge member 35b-1 is returned, the gripper 31 is opened by a coil spring 35b-4. The rear end of the holder 31a-1 is resiliently pushed on the surface of the wedge portion 35b-1. Mouthpieces 31a-2 are respectively welded to the opposed surfaces of the upper and lower holders 31a-1. The mouthpieces 31a-2 have the same width as the four first tape-like articles Tb to be able to grip simultaneously the four first tape-like articles Tb which are transferred in parallel.

In this tape-like article holding portion 31, when the wedge member 35b-1 projected from the end face of the lower bracket 35b is advanced, the gripper 31a is shut to hold the first tape-like article Tb. When the wedge member 35b-1 is returned, the gripper 31a is opened to release the first tape-like article Tb. The opening and shutting operation of the gripper 31a is synchronized with the actuation of the tape-like article pressing portion 32.

The fourth unit of this invention, the tape-like article winding unit 4 is disposed ahead of the double-sided adhesive tape sticking unit 2 in the tape-like article feeding direction as shown in FIG. 1, and is composed of a known winding means not shown in the drawing, a tape-like article guiding portion 41 and an empty spool supplying means 42. The winding means is naturally provided with a spool exchanging mechanism. The tape-like article guiding portion 41 is composed of plural guide plates 41a which are arranged in parallel at intervals about equal to the width of the first tape-like article Tb fed from the feed unit 1. The lower tip ends of the guide plates 41a are disposed adjacent to the peripheral surface of the winding spool 6 on the winding means. A guide roller 41b is rotatably supported in the rear end (left side in the drawing) of the guide plate 41a. Since four first tape-like articles Tb are simultaneously wound, three guide plates 41a are disposed in parallel at the predetermined intervals and the guide roller 41b is attached to the rear end of the guide plates.

Figure 10:
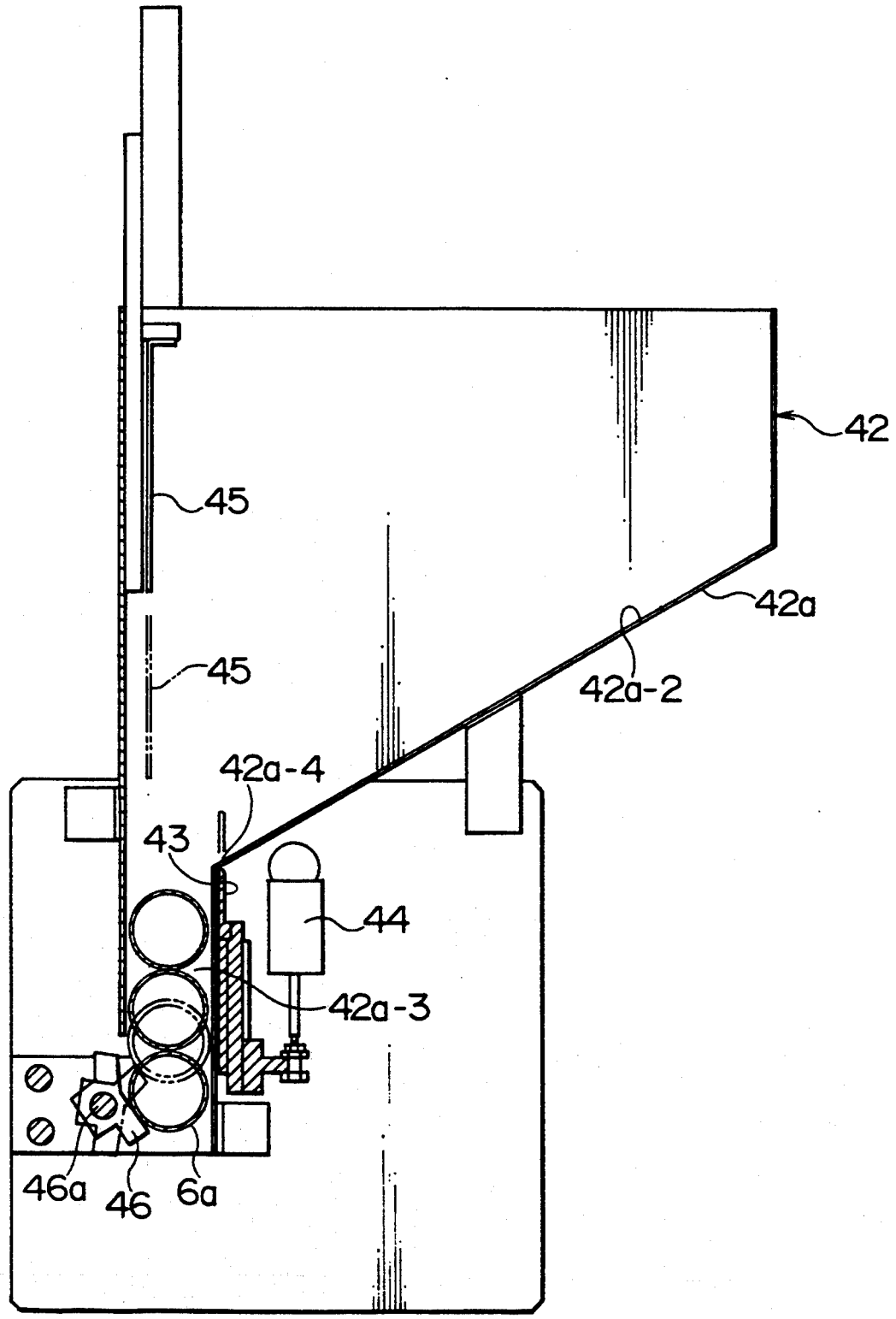
FIG. 10 is an enlarged vertical view in cross section showing the main structure of an empty spool supplying means used in this invention.

The empty spool supplying means 42 is composed of an empty spool supplying hopper 42a disposed in front of the winding means and an automatic delivering member 42b arranged below the empty spool discharging opening of the hopper 42a, as shown in FIG. 1. FIG. 10 shows an enlarged sectional view of the empty spool supplying hopper 42a. The empty spool hopper 42a comprises a square inlet, an slanted surface 42a-2 inclined toward the opposite side wall 42a-1 and an empty spool discharging path 42a-3 which is extended vertically from the position where the interval between the lower end of the slanted surface 42a-2 and the opposite side wall 42a-1 is about equal to the external diameter of the empty spool 6a. A slit 42a-4 is formed in parallel to the longitudinal direction of the empty spool 6a in the lower end portion of the slanted surface 42a-2. A plate 43 is moved vertically to be projected through the slit 42a-4 into the hopper and is disposed along the external wall of the empty spool discharging path 42a-3. The vertically movable plate 43 is actuated by the cylinder 44. A vertically movable pushing plate 45 is also provided on tile inner surface of the upper part of the opposite side wall 42. A plurality of the empty spools 6a accommodated in the hopper are individually separated from the block of the empty spools when the vertically movable plate 43 is projected vertically into the hopper, and the empty spools 6a are aligned and individually discharged into the empty spool discharging path 42a-3 when the push plate 45 is lowered to push tile empty spool.

A lateral V-shaped discharge-regulating member 46 is supported on a shaft 46a in the spool discharging opening of the lower end of the opposite side wall 42a-1 so that the discharge regulating member 46 can turn by the predetermined angle about the shaft parallel to tile longitudinal direction of the empty spool 6a. The discharge regulating member 46 is driven at the predetermined timing by a turning and driving means not shown in the drawing and always set in the position shown by the solid line in FIG. 10. When the leading empty spool 6a, is discharged, the discharge regulating member 46 returns to the original position to regulate the discharge of the succeeding empty spool 6a. The discharge regulating member 46 is turned between the solid line and the phantom line in FIG. 10 by a spring not shown.

The automatic delivering member 42b is disposed below the empty spool discharging opening of the empty spool supplying hopper 42a and has an empty spool support 47 which is reciprocated between the empty spool discharging opening and the spool supporting portion of the winding means by the cylinder 42b-1 as shown in FIG. 1. This empty spool support 47 is composed of an arm having an upwardly opened U-shaped section. The supporting portion 47a opposed to the winding means 4 usually stands upright by being urged by the spring 47b and is turned to the horizontal position when the load is applied from the inside to the supporting portion. Until the preceding winding is finished, the empty spool support 47 is located at the position shown in FIG. 1. Then, the succeeding empty spool 6a is discharged from the empty spool discharging opening of the empty spool supplying hopper 42a and is received by the empty spool support 47. If the empty spool 6a is not set on the empty spool support 47 because no empty spool 6a is discharged from the empty spool supplying hopper 42a, the non-existence of the empty spool is detected by a phototube sensor not shown in the drawing and the projecting plate 43 is actuated by a control means also not shown and projected upwardly to break the caked state of the empty spools 6a accommodated in the hopper 42a so as to discharge the empty spool 6a from the discharging opening. If the empty spool 6a is not yet discharged onto the empty spool support 47, the push plate 45 is lowered to align the empty spool 6a so as to discharge them through the empty spool discharging path 42a-3 from the empty spool discharging opening.

When the preceding winding is finished and the wound spool 6 is released from the winding means, the empty spool support 47 is advanced to the spool body supporting portion of the winding means. Then, when the empty spool 6a held by the empty spool support 47 is transferred to the winding means, the empty spool support 47 is returned. Since the shaft end of the empty spool 6a is held by the winding means, the supporting portion 47a is turned to the horizontal position against the spring force and returned to the original position while the empty spool 6a is kept on the winding means, so as to deliver the empty spool 6a finally.

The winding spool 6 is made of a paper tube or a plastic tube which is used usually. In the case for simultaneously winding a plurality of first tape-like articles Tb, the required numbers of winding spools 6 are held on a core tube and connected together to wind-up the plural tape-like articles at the same time.

According to the automatic winding machine for tape-like articles of this embodiment, when four winding spools 6 of the winding unit 4 are exchanged for new winding spools 6, the leading ends of the four first tape-like articles Tb are simultaneously fed for respective predetermined length from the discharge guide 14. Then, the double-sided adhesive tape feeding section 23 is disposed below and apart the press roller 22a as shown in FIG. 3. When the leading end of the first tape-like article Tb fed from the discharge guide 14 of the feed unit 1 reaches to the position projected forwardly from the press roller 22a while contacting with the lower surface of the press roller 22a, the double-sided adhesive tape feeding section 23 is lifted up to hold the leading end of the tape-like article Tb between the press roller 22a and the double-sided adhesive tape sticking roller 24f as shown in FIG. 4. And the adhesive tape severing means 26 is actuated to apply the cutting blade 27a to the surface of the double-sided adhesive tape 5 so as to sever the adhesive portion of the adhesive tape while leaving the separated paper 5a uncut.

When the adhesive portion of the adhesive tape 5 is severed, the cutting blade 27 is returned and the separated paper rewinding roller 24e is driven to start the rotation of the separated paper drawing roller 24d and to rewind the separated paper 5a on the rewinding roller 24e gradually. The first tape-like article Tb is drawn-out from the discharge guide 14 and the severed piece 5b of the adhesive tape 5a is stuck onto the back surface of the first tape-like article Tb by rewinding of the separated paper 5a in conjunction with drawing of the first tape-like article Tb. Then, the gripper 31a of the tape-like article drawing and winding unit 3 described later is standing by in front of the both press roller 22a and sticking roller 24f to hold the leading end of the first tape-like article Tb therebetween. When the whole severed piece 5b of the double-sided adhesive tape 5 is stuck onto the back surface of the first tape-like article Tb, the rotation of the separated paper rewinding roller 24e is stopped. At that time, the leading end of the first tape-like article Tb is fed into the inner portion of the gripper 31a standing-by in front of the press roller 22a and the sticking roller 24f while being held between the both press and sticking rollers 22a, 24f as shown in FIG. 6, so that the leading end portion is held by the gripper 31a. Thereafter, the double-sided adhesive tape supplying section 23 is lowered to start the predetermined movement of the gripper 31a while holding the first tape-like article Tb as shown in FIG. 7, so that the leading end of the first tape-like article Tb is transferred to the predetermined position of the tape-like article winding unit 4.

The tape-like article drawing and winding unit 3 provided with the gripper 31a is standing-by at the upward front location of the tape-like article winding unit 4 in winding of the first tape-like article Tb. When the double-sided adhesive tape 5 is stuck onto the leading end of the first tape-like article Tb, the drawing and winding unit 3 is moved horizontally to the tape-like article gripping position in front of the press roller 22a and the sticking roller 24f. After the leading end of the tape-like article Tb is gripped by the gripper 31a, the gripper 31a is returned to the stand-by position downwardly moved therefrom. Then, respective first tape-like articles Tb gripped by the four grippers 31a are guided through a guide roller 41b into respective spaces between the three guide plates 41a arranged in parallel at the predetermined intervals and the right and left flanges of the winding spool 6 and are further transferred to the peripheral surfaces of four connected winding spools 6.

When the leading end of the first tape-like article Tb is transferred by the gripper 31a to the peripheral surface of the spool 6, the tape-like article pressing portion 32 is inclined downwardly to push the leading end surface of the first tape-like article onto the peripheral surface of the winding spool 6 by the rollers 32c-1 of the press member 32c, so that the double-sided adhesive tape 5 stuck onto the back surface of the tape-like article is stuck and joined to the peripheral surface of the winding spool 6.

When this sticking and joining operation is finished, the tape-like article drawing and winding unit 3 is returned to the stand-by position and the winding unit 4 is actuated to start the winding of the first tape-like article. When the first tape-like article Tb is wound for the predetermined length, the feeding is stopped and the feed gripper 13 is actuated to project the second tape-like article Ta for the predetermined length through the second guide path 16b into the passage 17a of the movable cutter 17. The movable cutter 17 is lifted up to sever firstly the first tape-like article Tb and successively the projected end of the second tape-like article Ta in cooperation with the stationary cutter 16. Then, since the severed end of the first tape-like article Tb is put on the downwardly inclined lower surface of the passage 17a and bent upwardly, the severed piece of the second tape-like article Ta is projected rearwardly from the severed end of the first tape-like article Tb. The severed piece or joint piece of the second tape-like article Ta is attached to the severed end of the first tape-like article Tb and further wound onto the winding spool 6, and when the end of the first tape-like article Tb reaches to the wound surface layer, the tape-like article pressing portion 32 is again actuated to press and join the joint piece of the second tape-like article Ta projected from the wound end of the first tape-like article Tb onto the surface of the wound surface layer to finish the winding operation.

The above-mentioned operations are repeated, and the four first tape-like articles Tb in parallel are wound automatically for the predetermined length on the winding spools 6, so that the wound ends are joined to the surface of the wound surface layer to provide the wound products.

According to the automatic winding machine for the tape-like articles of this invention, the leading end and the trailing end of the tape-like article can be automatically and stably guided on the peripheral surface of the desired winding spool. The leading and trailing ends of the tape-like article are certainly stuck and joined to the peripheral surface of the conventional usual spool. These kinds of automatic winding machines can be completely automated to promote the reduction of labor and the productivity.

What is claimed is:

1. A machine for automatically winding a flexible tape-like article comprising, a double-sided adhesive tape sticking unit having a feed section for a double-sided adhesive tape, a severing section for severing the adhesive portion of said adhesive tape fed from said feed section into a predetermined length, and a rewinding section for intermittently rewinding a separated paper for a predetermined length, wherein said adhesive tape sticking unit is for sticking said severed adhesive portion to a back surface of a leading end of said tape-like article fed from said feed section, a tape-like article winding unit having an automatic exchanging mechanism for winding spools, and a guide means for said tape-like articles, wherein said winding unit is for winding said tape-like article for a predetermined length on said winding spool, and a tape-like article drawing and winding unit having a tape end gripping means for gripping the leading end of said tape-like article on the back surface of which the double-sided adhesive tape is adhered by said sticking unit, and a pressing and securing means for pressing and securing said leading end on the peripheral surface of said winding spool, wherein said tape-like article drawing and winding unit is displaceable between said adhesive tape sticking unit and said winding spool of said tape-like article winding unit.

2. A machine for automatically winding a flexible tape-like article according to claim 1, wherein a feed section of said tape-like article is a tape-like article feed unit having a feeding and severing portion for feeding and severing first and second tape-like articles for a predetermined length, and an attaching portion for attaching the severed piece of said second tape-like article to a trailing end of said first tape-like article.

3. A machine for automatically winding a flexible tape-like article according to claim 1, wherein guide members for guiding plural tape-like articles in parallel are disposed between said double-sided adhesive tape sticking unit and said winding spool of said tape-like article winding unit.

4. A machine for automatically winding a flexible tape-like article according to claim 1, wherein said tape-like article winding unit has an automatic empty spool supplying means.

* * * * *